United States Patent [19]

Thiersch et al.

[11] 4,263,101

[45] Apr. 21, 1981

[54] COKE OVEN DOOR ASSEMBLY

[75] Inventors: Friedrich Thiersch, Recklinghausen; August Lucas, Datteln-Horneburg, both of Fed. Rep. of Germany

[73] Assignee: Carl Still GmbH & Co. KG., Firma

[21] Appl. No.: 144,953

[22] Filed: Apr. 29, 1980

[30] Foreign Application Priority Data

May 12, 1979 [DE] Fed. Rep. of Germany ... 7913785[U]

[51] Int. Cl.[3] ..... C10B 25/06

[52] U.S. Cl. ..... 202/248; 110/173 R

[58] Field of Search ..... 202/242, 248; 110/173 R; 160/209

[56] References Cited

U.S. PATENT DOCUMENTS

| | | | |
|---|---|---|---|
| 1,643,766 | 9/1927 | Fahrenwald | 110/173 R |
| 1,915,937 | 6/1933 | Lecoca | 202/248 |
| 2,209,590 | 7/1940 | Wilputte | 202/248 |
| 2,293,434 | 8/1942 | Giese, Jr. | 202/248 |
| 2,606,865 | 8/1952 | Forsans | 202/248 |
| 3,426,829 | 2/1969 | McDaniel et al. | 160/209 |
| 3,505,174 | 4/1970 | Peterson et al. | 202/248 |
| 3,897,310 | 7/1975 | Tucker | 202/248 |
| 4,115,203 | 9/1978 | Naevestad | 202/248 |
| 4,189,352 | 2/1980 | Stanke | 202/248 |

FOREIGN PATENT DOCUMENTS 676505 6/1939 Fed. Rep. of Germany .

*Primary Examiner*—Frank W. Lutter
*Assistant Examiner*—Roger F. Phillips
*Attorney, Agent, or Firm*—McGlew and Tuttle

[57] ABSTRACT

A coke oven door assembly includes a door body having a plurality of plates vertically disposed in series. Refractory blocks attached to the plates include overlapping side portions in spaced relationship with their adjacent ends. The plates are tiltingly interconnected with each other.

15 Claims, 4 Drawing Figures

COKE OVEN DOOR ASSEMBLY

FIELD AND BACKGROUND OF THE INVENTION

The present invention relates in general to a new and useful coke oven door, and more particularly, to a coke oven door for high horizontal coke oven chambers having a door frame with a sealing surface, a door body with a sealing membrane having a sealing profile for pressing against the sealing surface of the door frame, refractory door stoppers for protecting the steel structure of the door from the effects of heat generated in the hot oven chamber and with locking bolts distributed over the full height of the door frame.

Coke oven doors with seals are known in various forms. A common feature of the various forms is represented by the use of elastic seals which can be pressed against the sealing surface of the door frame through the tightening of the bolts or springs or the use of malleable strips which can be hammered to compensate for uneveness caused, for example, by deposits on the sealing surfaces of the door frame and door.

West German Offenlegungsschrift No. 2 509 430 discloses a construction of a coke oven door wherein a membrane plate is carried by a frame. The membrane is provided along its periphery with edge elements having sealing strips designed to coact with the sealing surfaces of the door frame. The two vertical sides of the membrane are coordinated to locking rods which are slidably supported by the door frame and which rest on the edge elements and which can be engaged with locking bolts at the vertical sides of the door frame.

In the known arrangements, the sealing profiles leave available only a narrow space of play for the compensation of unevenness. This is disadvantageous in that the sealing profiles are not capable of sufficiently adapting to the deformations and roughness of the sealing surface of the door frame which arise under continuous operating conditions due to the high thermal loads. To alleviate these sealing difficulties, West German Pat. No. 676505 discloses the placement of a pressure frame, subdivided by hinges in front of the sealing profile.

The frame is connected to straps with pressure fingers on the sides. The frame acts by means of the straps against the sealing profile. This arrangement requires, however, an additional pressure frame which is ineffective in case the carrying door body that is not sufficiently positioned parallel to the door frame.

SUMMARY OF THE INVENTION

It is an object of the invention to provide a coke oven door assembly for closing the opening of a coke oven chamber, which can adjust to the bending of the door frame induced by thermal and mechanical load during operation while assuring a complete sealing of the oven chamber.

This object is achieved, in accordance with the present invention, by providing a novel door body, of the type which lined with refractory door stopper blocks that is composed of two or more door elements hingedly connected to each other like the links of a roller chain. Each individual element is rotatably disposed at its top and bottom around a horizontal axle extending in the direction of the length of the coke oven block and the outer ends of the axles are solidly nested behind the locking bolts of the door frame.

It is possible with the construction of the door of the present invention to maintain a narrow nearly uniform distance between the door and the frame over the full door height, even in the event that a large bending of the door frame occurs, since each door element is held and pressed by the locking bolts at the top and bottom thereof. Smaller unevenness due to deposits on the sealing surfaces is compensated for by the elasticity of the sealing profiles.

In accordance with a further preferred embodiment of the present invention repositionable wedge-shaped pieces are disposed in slots at the locking bolts. Rollers are provided at the ends of the axles of the door body elements. The rollers can be lowered and the ends of the axles, at the same time, moved towards the door frame. In this embodiment of the locking bolt, the usual bolting of the doors with bolt and bolting bar is replaced by moving the door with the sealing strip on the inclined plane of the locking bolt arrangement towards the sealing surface of the door frame and by having the door against the sealing surface biased by its own weight.

It is particularly advantageous to provide, at the lowest door element, a pulling device with a rotatable eccentric lever for generating additional pressure required for good sealing of the door which operates by pulling the door towards the ground.

In accordance with an alternative embodiment of the present invention, the connection of the door body elements by horizontally running axles can be replaced by a connection provided by flexible, thin steel plates. For locking, corresponding bolts with rollers are disposed on the outside of the door body elements in order to prevent self locking.

The refractory door stopper block can be provided in the form of a rigid continuous slab anchored to the coke oven door of the present invention, as is conventional with doors, and the slab can be attached to the door body such that the weight of the stopper block is carried only by the upper part of the door body so that in the lower region the required open space at the door body element is maintained.

It is furthermore desirable, according to the present invention, to secure a refractory block to each of door body elements. The stopper blocks can be attached to the corresponding door body element and they can also be fitted against each other. In order to avoid the passage of radiative heat directly through the intervals between the blocks to the iron material of the door, according to the present invention, a corbeled or stepwise transfer is provided from one door stopper block to another door stopper block.

Thermal blending of the door is advantageously eliminated in accordance with the inventive arrangement. It is a further advantage of the invention that upon bending of the door frame, the door adapts to the running of the sealing surface and to the contour of the frame without change in the contact pressures between sealing strips and sealing surfaces.

It is still a further advantage of the inventive arrangement that the contact pressures are initiated at several points distributed over the length of the door. In accordance with the invention, moreover, the usual bolts and bolting hooks are not required and the weight of the door body can be lightened. Furthermore, the bolting wedges at the frame can be advantageously adjusted as desired in order to locally increase or decrease the pressure imposed on the sealing surface.

Accordingly, it is an object of the invention to provide an improved coke oven door assembly, for closing and opening to a high horizontal coke oven chamber, of the type having, in combination, a door frame with a sealing surface bordering the opening, a movable door body defining a closure for the opening, a refractory member operatively connected to the door body for protecting the structure thereof from overheating, and a sealing membrane mounted on the door body for sealingly engaging the sealing surface and sealing the opening. The improved door body includes a plurality of plates vertically disposed in series. The refractory member includes a plurality of refractory blocks. One of the blocks is anchored to a respective one of each of the plates on the side thereof adjacent to the oven chamber. Each of the refractory blocks has an overlapping side portion disposed in a space relationship at their adjacent ends. Connecting means are provided for tiltingly interconnecting adjacent ones of the plates.

It is a further object of the invention to provide an improved coke oven door assembly which is rugged in construction, simple in design and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
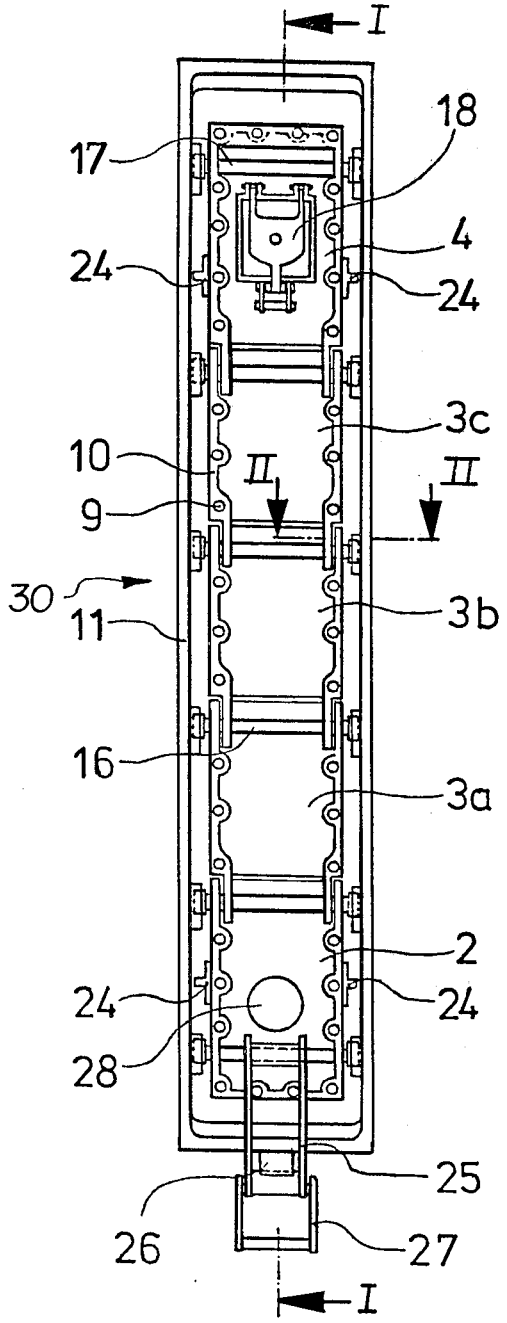
FIG. 1 is a front elevational view of a schematically represented coke oven door.
Figure 2:
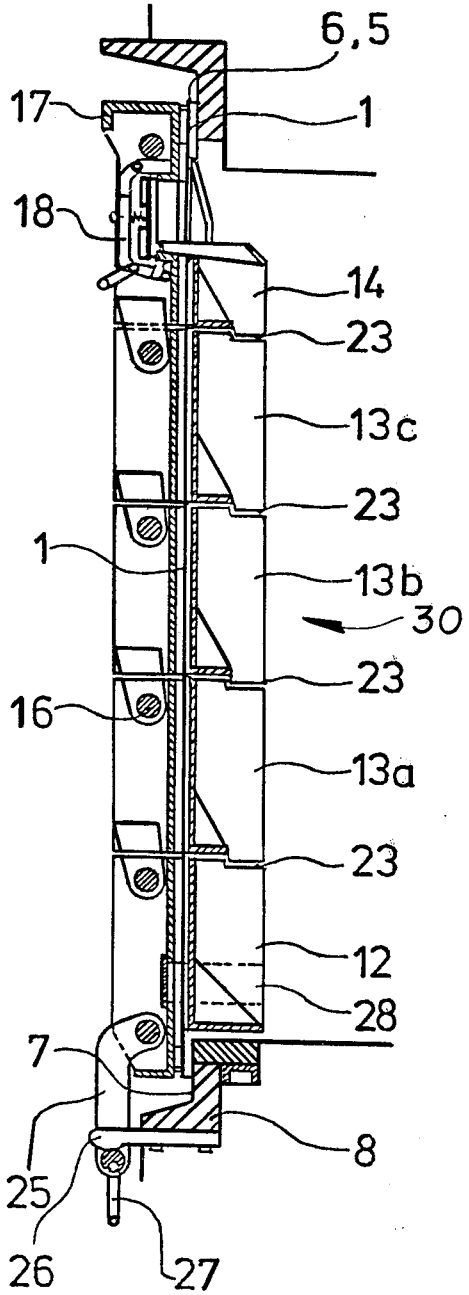
FIG. 2 is a longitudinal sectional view taken along section line I—I of FIG. 1.

Referring now to the figures which illustrate a preferred embodiment of the invention, FIGS. 1 and 2 illustrate a coke oven door assembly 30 which comprises a plurality of plates or door body elements 2, 3*a–c*, and 4, each of which are hingedly or tiltingly interconnected to adjacent door body elements, in a manner similar to the links of a roller chain. As shown, the door body elements are arranged in a vertically disposed series. A door refractory stopper block 2, 8*a–c*, and 4 is anchored to each of the respective door body elements 2, 3*a–c*, and 4. The stopper blocks are shaped such that a portion on the side of each block adjacent to the coke oven chamber projects beyond a portion of the surface of the block therebelow, the latter surface being adjacent the door body element.

A thin central membrane plate 1 is disposed over the full height of the door 30 intermediate the door body elements and the stopper blocks and is attached to the individual door body elements by bolts (not shown). Guide slots (not shown) provided in the membrane plate 1 for receiving the bolts, allow slight shiftings of the membrane plate 1 upon the mutual tilting of the door body elements. An edge element 5 is positioned on the side of the membrane plate 1 (see FIG. 3) adjacent the door frame 8 which borders the periphery of the opening of the coke oven. The edge element 5 traverses over the full periphery of the membrane plate 1. The edge element 5 has a groove carrying a thin sealing strip 6 which contacts a sealing surface 7 of the door frame 8 when the door is closed.

The membrane plate 1, the edge element 5 and the sealing strip 6 are pressed against the sealing surface 7 by pretensioned spring blocks 9, which are connected to integral ribs 10 of the door body elements in multiple numbers.

Figure 3:
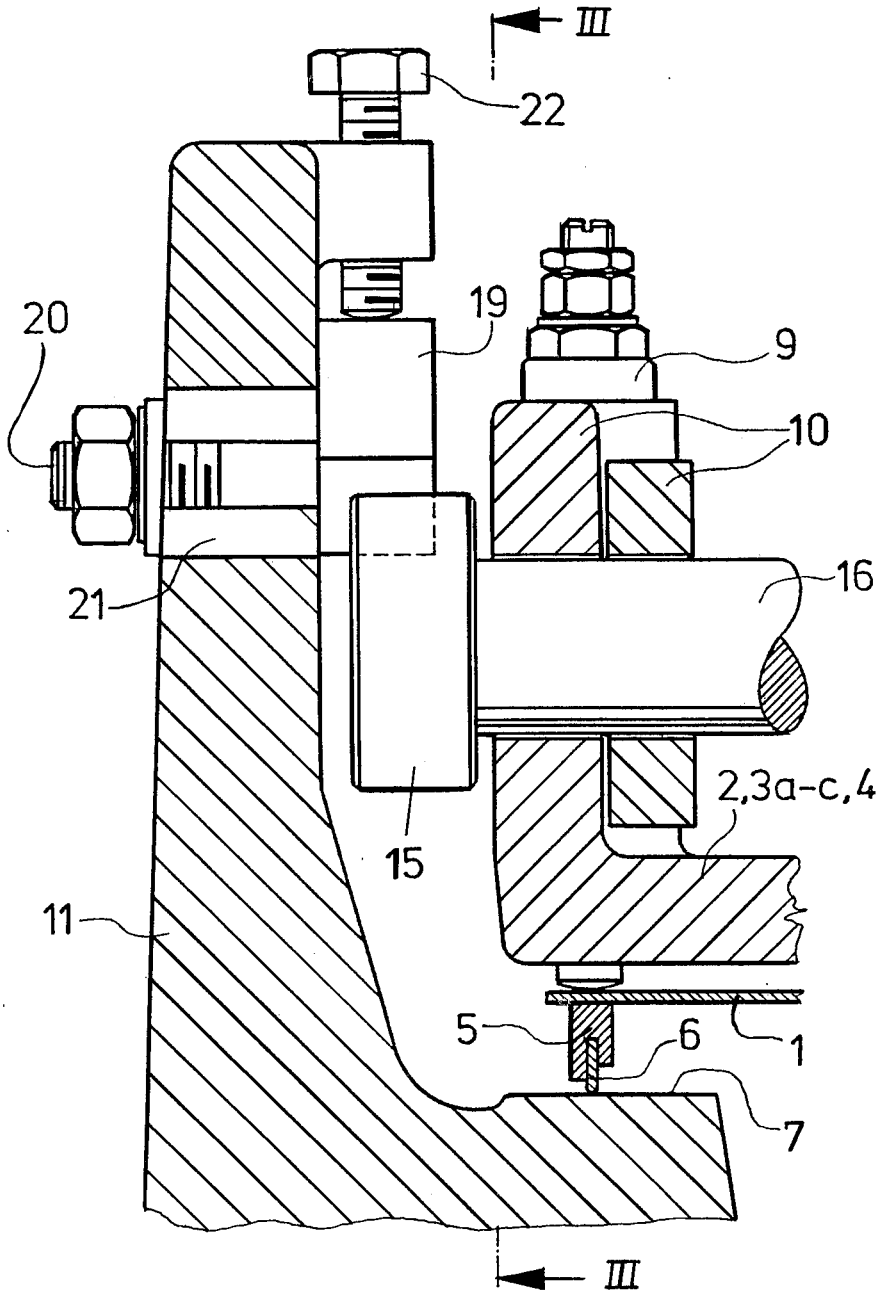
FIG. 3 is a sectional view taken along section line II—II of FIG. 1.
Figure 4:
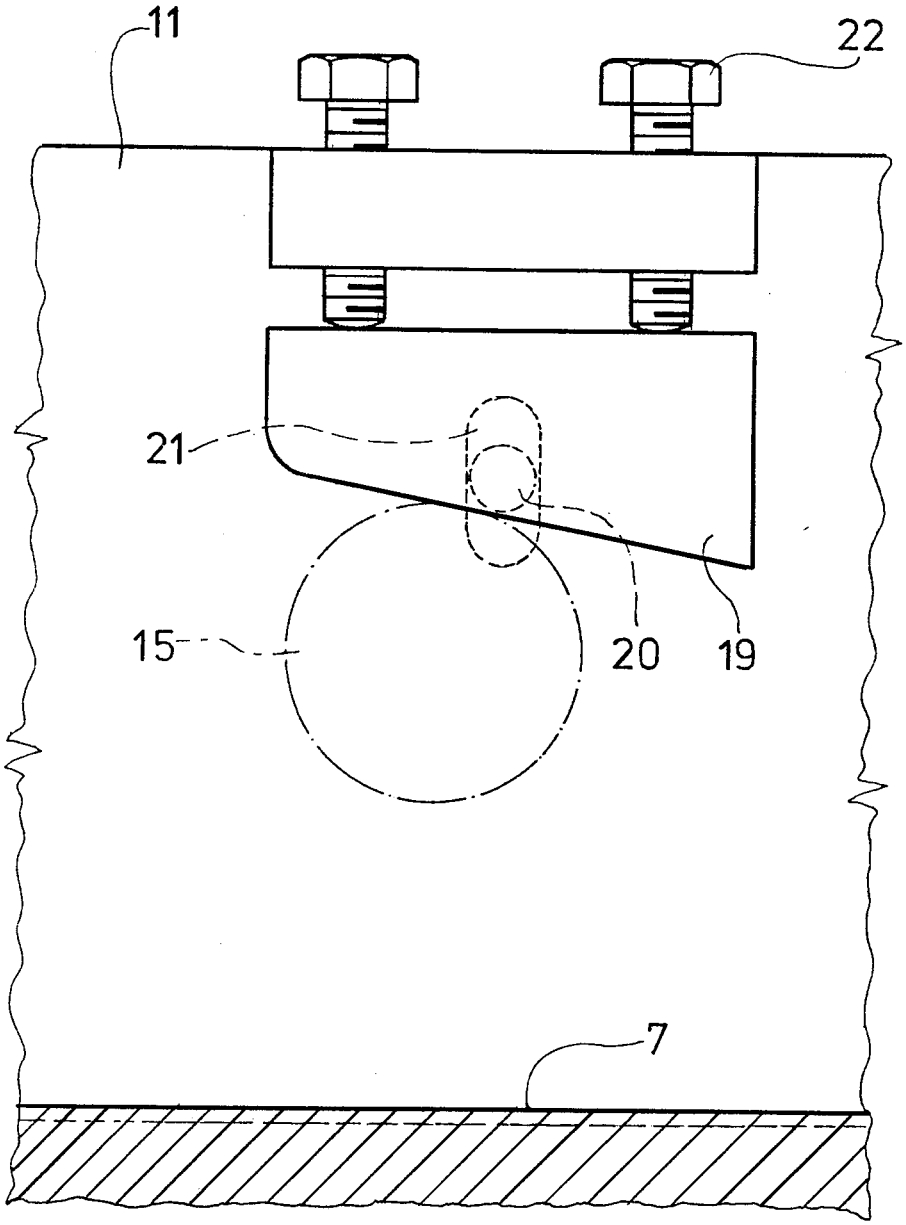
FIG. 4 is a sectional view along section line III—III of FIG. 3.

The door frame 8, as best shown in FIGS. 3 and 4, carries wedge-shaped pieces 19 at its side flanges 11. The location of wedge-shaped pieces 19 can be adjusted in respect to their relative position with the sealing surface 7 by bolts 20 in slots 21. The wedge-shaped pieces 19 may be fixedly positioned by locking bolts 22.

The adjacent door body elements 2, 3*a–c* and 4 are connected by axles 16 to each other to form a flexible door body. Each of the axles, has free ends extending beyond the width of the door. A roller 15 is mounted on each end of each of the axles.

The uppermost door body element 4 is provided with a lifting pocket 17, through which a door lifing machine (not shown) can actuate movement of the entire door for lifting, carrying and positioning, and with a level door required on the machine side.

The flexibility of the door is limited by the predetermined distance set between the individual slab stopper elements. Preferably, an elastic sealing material, such as a ceramic wool, is placed into the joints 23 between the stopper block elements 12, 13*a–c* and 14 in order to prevent the deposit there of tar and coal which could prevent or impede the relative motion of the door blocks with respect to each other.

A pulling device 25 is attached at the lowermost door body element 2. The required contact pressure of the sealing strips 6 against the sealing surface 7 is achieved via the end support 26 of the door frame 8 and a manually or machine actuated eccentric lever 27 which is rotatable to engage end support 26 and pull the door downwardly. An opening 28 in the lowermost door body element 2 of the door body and its associated door stopper 12 for inserting a gas feeding tube (not shown) to heat up the coke oven block.

The exact positioning of the coke oven door in the door frame 8 is facilitated by the guide piece 24 attached at the top and at the bottom of the long sides of the door body.

While a specific embodiment of the invention has been shown and described in detail to illustrate the application of the principles of the invention, it will be understood that the invention may be embodied otherwise without departing from such principles.

What is claimed is:

1. A coke oven door assembly for closing an opening of a high horizontal coke oven chamber comprising a door frame bordering the opening with a sealing surface, a door body, a sealing membrane mounted on the door body for sealingly engaging the sealing surface of the door frame, a refractory door member mounted on said door body for protecting said door body against that of the hot oven chamber, locking means connected to said frame for engaging said door body for urging the sealing membrane into engagement with said sealing surface, said door body including at least two plates disposed in series, connecting means for tiltingly interconnecting adjacent ones of said plates around a horizontal axis running in the longitudinal direction of the coke oven.

2. The coke oven door assembly according to claim 1 wherein said connecting means includes an elongated axle having ends disposed intermediate said locking means and said sealing surface.

3. The coke oven door assembly according to claim 1 wherein said locking means includes a plurality of wedge-shaped members, each of said wedge-shaped members having a slot extending therethrough, a plurality of bolts connected to said frame, each of said bolts extending through a respective slot being operative to adjustably fix the location of a respective wedge-shaped member.

4. The coke oven door assembly according to claim 3 wherein said connecting means includes an elongated axle having ends disposed intermediate said wedge-shaped member and said sealing surface, roller means mounted on each end of said axle ends for engaging said wedge-shaped members to thereby simultaneously lower said plates and move said plate toward said door frame.

5. The coke oven door assembly according to claim 1 further comprising lever means rotatably connected to at least one of said plates, said lever being rotatably operative to engage said frame to move said door into a position closing the opening.

6. The coke oven door assembly according to claim 1 wherein said sealing membrane is a flexible metallic membrane and connects each of said plates.

7. The coke oven door assembly according to claim 6 wherein said metallic membrane is disposed intermediate said plates and said refractory door member.

8. The coke oven door assembly according to claim 4 wherein said sealing membrane is a flexible metallic membrane and connects each of said plates.

9. The coke oven door assembly according to claim 8 wherein said metallic membrane is disposed intermediate said plates and said refractory door member.

10. The coke oven chamber according to claim 1 wherein said refractory door member includes a plurality of refractory blocks, one of said blocks being anchored to a respective one of said plates on a side thereof adjacent to the oven chamber, each of said refractory blocks having overlapping side portions disposed in a spaced relationship at their adjacent ends.

11. The coke oven door assembly according to claim 10 wherein said locking means includes a plurality of wedge-shaped members, each of said wedge-shaped members having a slot extending therethrough, a plurality of bolts connected to said frame, each of said bolts extending through a respective slot being operative to adjustably fix the location of a respective wedge-shaped member.

12. A coke oven door assembly according to claim 11 wherein said connecting means includes an elongated axle having ends disposed intermediate said wedge-shaped members and said sealing surface, roller means mounted on each end of said axle ends for engaging said wedge-shaped member to thereby simultaneously lower said plates and move said plate toward said door frame.

13. A coke oven door assembly according to claim 12 further comprising a flexible metallic membrane connecting each of said plates.

14. The coke oven door assembly according to claim 13 wherein said metallic membrane is disposed intermediate said plates and said refractory door member.

15. An improved coke oven door assembly, for closing an opening to a high horizontal coke oven chamber, of the type having, in combination, a door frame with a sealing surface bordering the opening, a movable door body defining a closure for the opening, a refractory member operatively connected to the door body for protecting the structure thereof from overheating, and a sealing membrane mounted on the door body for sealingly engaging the sealing surface, and sealing the opening, the improvement wherein the door body comprises a plurality of plates vertically disposed in series, the refractory member includes a plurality of refractory blocks, one of said blocks being anchored to a respective one of said plates on a side thereof adjacent to the oven chamber, each of said adjacent refractory blocks having overlapping side portions in spaced relationship at their adjacent ends, and connecting means for tiltingly interconnecting adjacent ones of said plates.

* * * * *